US005820109A

United States Patent [19]

Jermyn et al.

[11] Patent Number: 5,820,109

[45] Date of Patent: Oct. 13, 1998

[54] REMOTELY OPERATED LIFT SYSTEM FOR UNDERWATER SALVAGE

[75] Inventors: Kevin Jermyn; Steve Gorin, both of Panama City, Fla.

[73] Assignee: The United States of America as represented by the Secretary of the Navy, Washington, D.C.

[21] Appl. No.: 695,073

[22] Filed: Jul. 19, 1996

[51] Int. Cl.[6] ..... B66D 1/12

[52] U.S. Cl. ..... 254/362; 254/323; 441/25; 441/40

[58] Field of Search ..... 254/269, 362, 254/323; 114/50, 51, 254, 244; 441/40, 131, 23–27, 3

[56] References Cited

U.S. PATENT DOCUMENTS

| | | | |
|---|---|---|---|
| 1,605,343 | 11/1926 | Gould et al. | 441/24 |
| 2,683,270 | 7/1954 | Long | 441/40 |
| 2,830,309 | 4/1958 | Lawson | 441/25 |
| 4,319,372 | 3/1982 | Tausig | 441/25 |
| 5,316,265 | 5/1994 | Welch et al. | 254/362 |
| 5,327,592 | 7/1994 | Stump | 254/362 |
| 5,397,258 | 3/1995 | Switlik et al. | 441/40 |

*Primary Examiner*—Katherine Matecki
*Attorney, Agent, or Firm*—Harvey A. Gilbert; William C. Townsend

[57] ABSTRACT

A system for retreiving undersea salvage items from a sub-surface location. The system includes a flotation unit, winch, related remote control unit and a power supply mounted thereon, a winch, related remote control unit, and a power supply mounted on the support element. A cable or equivalent secured to the winch includes a retrieval harness or alternative means such as a shackle for securing the salvage item to the winch. A tether connects the system to a remote salvage tender on the surface. An adjustable and automatic stop is provided by the control unit to prevent certain types of salvage from rising beyond a desired depth or breaching the surface. Portions of the system used in magnetic mine retrieval are fabricated of non-magnetic material.

16 Claims, 2 Drawing Sheets

REMOTELY OPERATED LIFT SYSTEM FOR UNDERWATER SALVAGE

The present invention relates to underwater salvage and, in particular, relates to an apparatus for remotely lifting underwater salvage from a free-floating surface platform.

BACKGROUND OF THE INVENTION

The problem to which this invention is directed is the recovery of ordnance and all other salvage items located on the ocean floor at depths to 300 feet. Previously, recovery of such salvage was performed with an underwater lift balloon. The lift balloon and its required gas supply were taken down to the ordnance item where they were attached. The diver then left and moved away from the ordnance and remotely activated the gas supply which filled the balloon, lifting it to the surface. This approach has several disadvantages. It required the diver to carry a bulky and heavy gas supply and balloon down to the ordnance item. Also, since the ordnance may be set off by magnetic items, the gear including the gas supply, lift balloon, valving, firing mechanism, and the harness must be nonmagnetic. The construction of nonmagnetic items is expensive and difficult. The lift balloon is uncontrolled on its ascent to the surface because, as the balloon rises in the water column, the gas inside it expands causing even more rapid ascent. These lift balloons have been known to be damaged from the rapid ascent. At least one balloon had split from the rapid ascent and, in that instance, the ordnance fell back to the bottom. The large surface area of the balloon also makes it susceptible to drifting in currents and difficult to tow.

SUMMARY OF INVENTION

It is thus an object of the present invention to provide a system on the ocean surface for recovery of salvage items weighing up to 2500 pounds from the ocean floor at depths of up to three hundred (300) feet.

It is further an object of the present invention to provide a flotation capability supporting a motorized winch and power source for lifting salvage items from the subsurface ocean environment to the surface zone for recovery.

It is still another object of the present invention to provide a surface located flotation system including a remotely controllable winch and power source for lifting salvage items from the subsurface ocean environment to the surface zone for recovery.

It is yet another object of the present invention to provide a surface located, remotely controllable motorized winch and power source for lifting a subsurface salvage item from the ocean bottom or intermediate depth above the bottom to an operator selected point below the ocean surface.

It is finally another object of the present invention to provide a surface located system for recovery of magnetically sensitive salvage items from the subsurface ocean environment without causing magnetic disturbance to the salvage item adversely affecting safety or recovery.

The present invention is a surface located remotely operated salvage lift system. The system employs a flotation unit providing approximately 4000 pounds of flotation contained within a harness that permits tethering the system to a salvage tender located nearly and to an anchor embedded in the sea bottom to restrict system movement during salvage. A floor-like support platform is affixed to the top of the flotation unit. A rigid or semi-rigid protective cover or skid plate is affixed to the bottom of the flotation unit to protect it during towing. The skid plate also acts as a container into which the system can be collapsed and secured for transport. A motorized winch capable of lifting weights up to 2500 pounds from a depth of about 300 feet, a remotely operable control unit, and a power source are mounted on the support platform and interconnected electrically to permit remote operation from the salvage tender and a diver in the water. The winch has a built-in automatic stop so that the salvaged item is lifted to approximately ten (10) feet below the surface. A nonmagnetic lifting line having one end connected to the winch and an opposite end having a shackle or other means for attachment to the salvage item extends through an opening in the support platform to the undersea environment. The lifting line is capable of lifting 2500 pounds but can obviously be sized to the system for specific salvage applications. The lifting line is retrieved by the diver from the surface platform. The diver swims to the salvage item as the winch feeds out the lifting line. The diver attaches the lifting line to the salvage item and returns to the surface to enter the tow craft. The winch is activated remotely and allowed to lift the item to the surface. The tow then tows the system and attached salvage item to the beach or recovery area.

The lift system of the present invention has several advantages over previous lift systems. Since the diver does not have to carry the gas supply and lift balloon, it is much easier to connect up the system. Since the lifting line is the only item that approaches the ordnance, it is the only item that must be nonmagnetic. In the prior art, the gas supply, lift, balloon, valving, firing mechanism and the harness must be nonmagnetic. The construction of nonmagnetic items is expensive and difficult so this new system will reduce the cost. Since the flotation does not move through the water column, the buoyancy does not change and there is much greater control over the ordnance item. The combination of ease of attachment and improved control while lifting allows the present invention to be used in rougher seas. Although there are many winch systems available in the prior arts, the use of the present invention for underwater retrieval of salvage items such as ordnance requires special features. New features include portability, towability, remote actuation, automatic stopping and braking feature, and a nonmagnetic lifting line.

DETAILED DESCRIPTION

With reference to the drawings, the invention is the lift system 10 which is employed on the ocean surface to lift a salvage item 14 any where beneath the ocean surface. The invention 10 can, of course, be sized to lift salvage items of various sizes, weights, and configurations from the subsurface ocean environment.

The lift system 10 comprises a flotation unit 18 shown in a donut shaped and inflatable tubular structure having one or preferably more than one air chamber. A plurality of air chambers is desired for redundancy to maintain flotation in the event an air leak occurs in one chamber.

Figure 1:
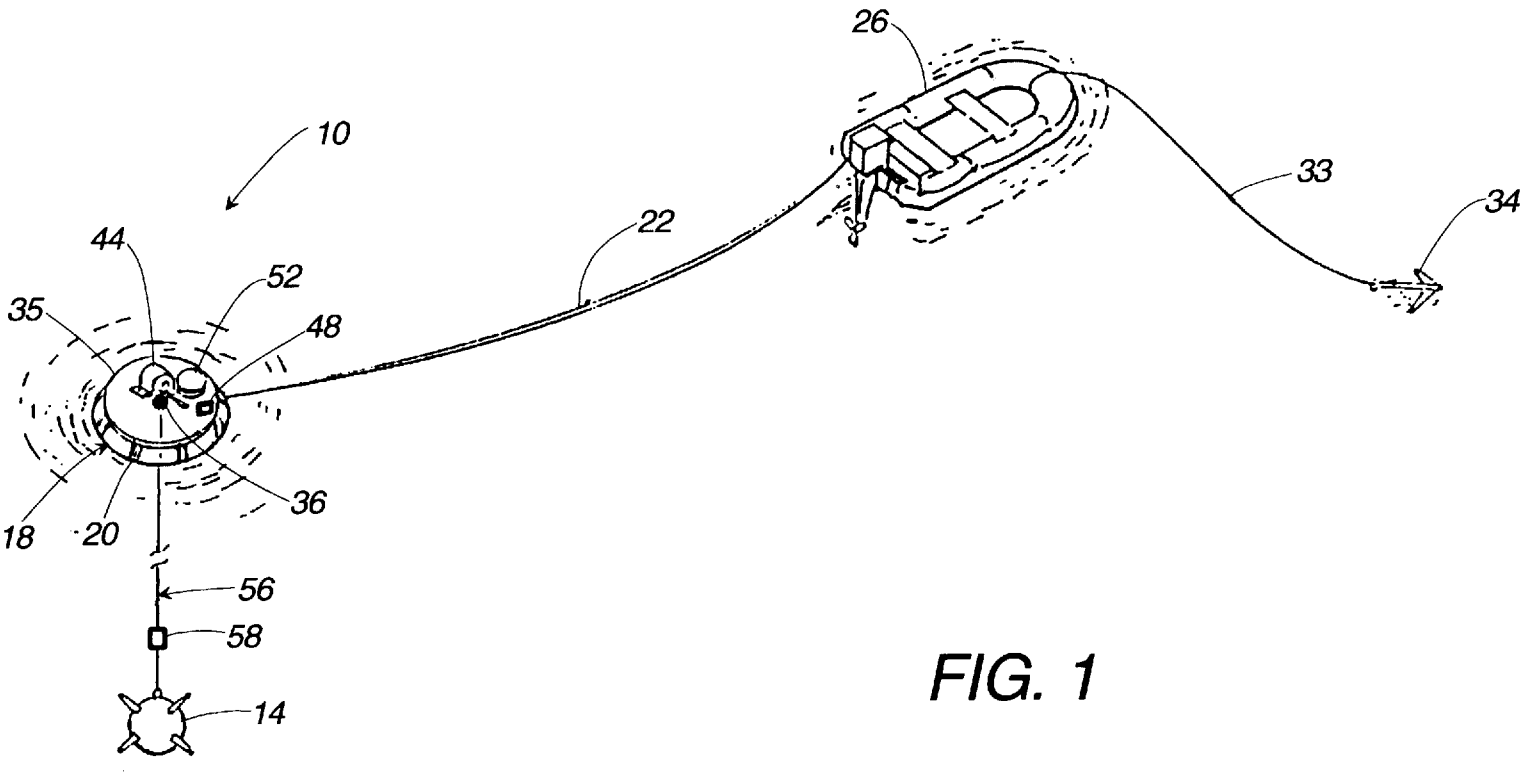
FIG. 1 is a view of the invention in an operating situation.

The flotation unit 18 is surrounded by a harness 20 of high working strength tubular woven nylon or equivalent webbing. Stainless steel connection means such as "O" or "D" shaped rings are located at appropriate points on the harness 20 to provide attachment points for connections of tethers of rope or webbing of tubular or non-tubular types. The tether 22 connects the harness 20 surrounding the flotation unit 18 to the salvage tender 26. The tender 26 is connected to the anchor 34 by means of the anchor line 33, as shown in FIG. 1.

Figure 2:
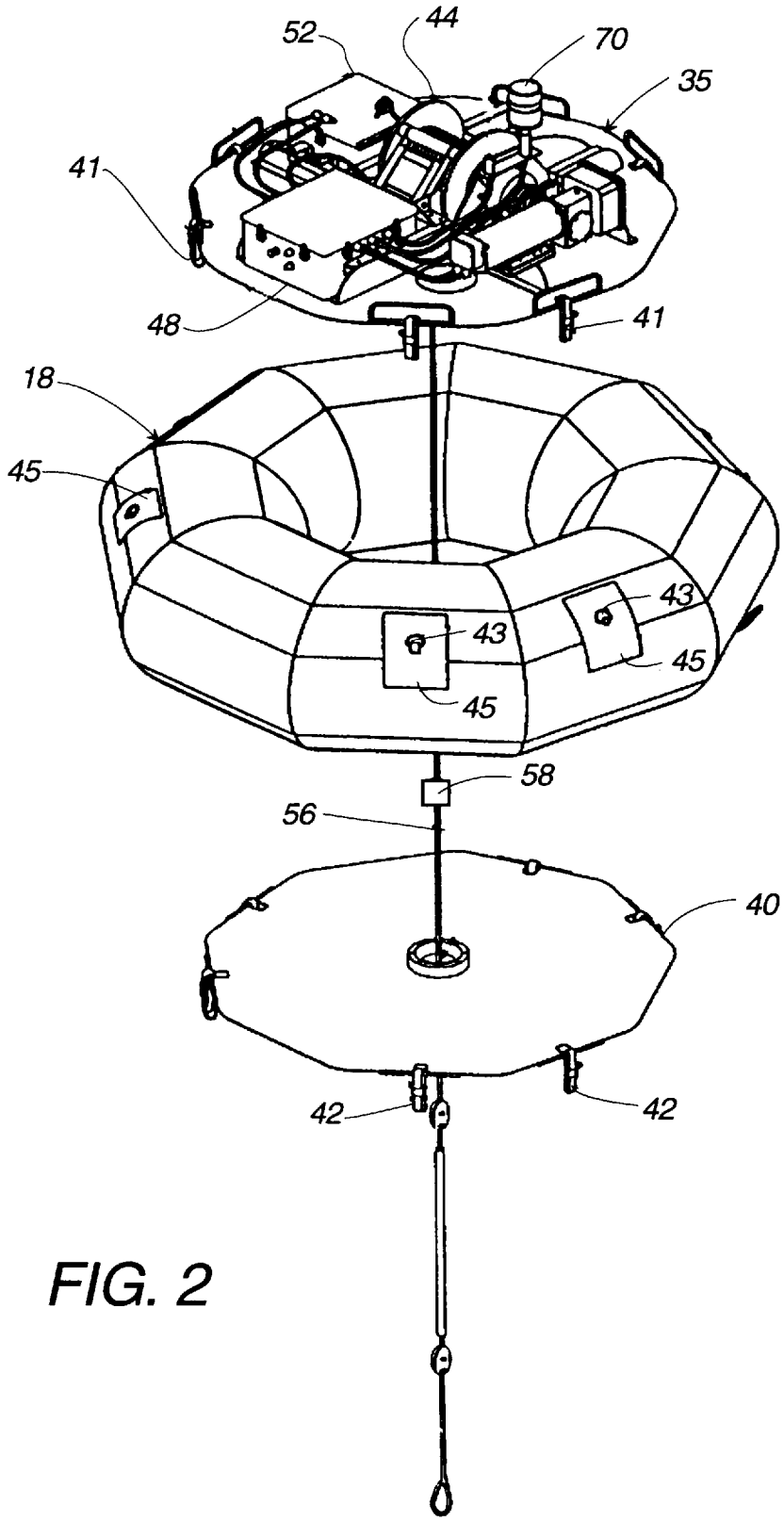
FIG. 2 is a perspective view of the flotation unit.

The support platform 35 is affixed to the top-side of the flotation unit 18 by means of heavy duty attachment straps 41 connected to attachment rings 43 secured to reinforcement patches 45 affixed to the flotation unit 18, as depicted in FIG. 2. A bottom skid plate 40 is shown affixed to the bottomside of the flotation unit 18 by means of heavy duty attachment straps 42 connected to the attachment rings 43. An opening 36 is provided in the support platform 35 to provide access from the side of the support platform facing sky ward to the ocean surface. A powered winch 44 is mounted to the support platform 35 and is connected to the control unit 48 which is shown likewise mounted to the support platform 35. The control unit 48 is connected to the power source 52 which is also mounted to the support platform 35. The power source 52 may be a gel cell type battery or other means for providing stored energy known to those skilled in the arts. The control unit 48 transfers power from the power source 52 to the winch 44 when remotely operated by salvage personnel in the water or in the salvage tender 26. One end of the lifting line 56 is connected to the winch 44. The opposite end of the lifting line 56 extends through the opening 36 in the support platform 35 and into the sub-surface underwater environment. The end of the lifting line 56 in the underwater environment may be fitted with any of a variety of shackle, harness, or other means for securing the cable-like lifting line 56 to the salvage item 14 in preparation for lifting by the winch 44.

A means for presetting a stop point for limiting the maximum level of travel of the salvage item 14 from the ocean floor or other subsurface location at which a salvage item 14 is found is connected to the control unit 48. This connection may be made internal or external to the controls unit 48. In addition, a mechanical stop means 58 for stopping the upward travel of a salvage item 14 may be affixed at a particular point on the lifting line 56 dictated by the type of salvage item 14 being lifted. The mechanical stop means 58 is easily attached to and easily removable from the lifting line 56. The mechanical stop means 58 trips an appropriately located stop switch 60 connected between the powered winch 44 and the power source 52.

A prototype of the system was built with a 3 Hp, 24 VDC winch manufactured by Thern, Inc., a remote control manufactured by Microtronics with a range of 1000 feet, 2 gel cell 12 volt batteries, and a flotation bladder manufactured by Firestone. The line used for lifting the object is ⅜", 14,000 pound breaking strength synthetic fiber line. The system contains an automatic interlock system to shut off the winch with the ordnance hanging at a preselected height. A braking system was added to the winch to allow the ordnance to be lowered without damaging the system. A strobe light 70 was added to indicate when the winch is being powered. A bottom skid plate 40 of rigid or semi-rigid material was secured to the bottom of the flotation unit 18 by attaching the straps 42 to the attachment rings 43. The skid plate 40 was constructed and mounted to protect the flotation unit from damage and to provide better stability while under tow. The bottom skid plate 40 was fabricated from high-impact plastic. Alternative corrosion resistant materials can be substituted. Eight (8) heavy duty nylon straps 41 were used to secure the support platform 35 to the flotation unit 18 and eight heavy duty nylon straps 42 were used to secure the bottom skid plate 40 to the flotation unit. The use of a flexible attachment between the support platform 35 and the skid plate 40 allows the deflation of the bladder and collapsing of the system into the skid plate 40, therefore, reducing the storage space required.

Materials used in fabricating the various elements of the system are selected for compatibility with the undersea environment and the nature of the salvage item, particularly in regard to recovery operations safety. Thus, marine quality stainless steels, synthetic materials for the flotation unit, harness, and tethers, and anti-magnetic materials for use in contact with and proximity to the salvage item are used as salvage considerations dictate.

Although the invention has been described with a certain degree of particularity, it is understood that the present disclosure has been made only by way of example and that numerous changes in the details of construction and the combination and arrangement of parts may be resorted to without departing from the spirit and the scope of the invention as hereinafter claimed.

What we now claim for our invention is:

1. A remotely operable, floating system for lifting underwater salvage items to the ocean surface, comprising:

means for providing flotation on the ocean surface, said means having a top side disposed above the ocean surface and an opposite bottom side in contact with the ocean; and a floor-like support means having one side facing away from the ocean surface and an opposite side facing the ocean surface, affixed to the top side of said flotation providing means;

means for attaching to and lifting underwater salvage items to the ocean surface, said means affixed to said support means;

means for providing stored energy to operate said attaching and lifting means, said means affixed to said support means; and means for remotely controlling the operation of said attaching and lifting means, said controlling means connected between said attaching and lifting means and said stored energy means, said remotely controlling means disposed upon said support means.

2. The apparatus of claim 1 further comprising a means for protecting the bottom of said flotation providing means, said protecting means affixed to the bottom side of said flotation providing means.

3. The apparatus of claim 2 where said bottom protecting means comprises a skid plate.

4. The system of claim 1 further, comprising:

means for pre-setting a stop point at which said salvage item can be stopped as it is lifted from its subsurface location.

5. The system of claim 4 wherein said means for attaching and lifting underwater salvage comprises:

a motorized winch mounted to said floor-like support means; and a cable-like means having one end connected to said winch and an opposite end having a means for securing said underwater salvage to said cablelike means.

6. The system of claim 5 wherein said floor-like support means has an opening therethrough providing a passage from the side facing away from the ocean through the side facing the ocean.

7. The system of claim 6 wherein said winch is mounted to the side of said floor-like support means facing away from the ocean and said cable-like means extends from said winch through said opening and into said ocean.

8. The system of claim 5 wherein said cable-like means is a length of tubular webbing having a working strength adequate for the particular salvage item.

9. The system of claim 5 wherein said means for securing said underwater salvage to said cable-like means is a tubular-webbing harness of adequate working strength for the particular salvage item.

10. The system of claim 5 wherein said means for securing said underwater salvage to said cable-like means is a diver-securable shackle.

11. The system of claim 5 wherein said cable-like means is non-magnetic.

12. The system of claim 1 further comprising a tether between said system and a salvage tender.

13. A remotely operable floating lift system for performing underwater salvage from the ocean surface, comprising:

a floatation unit having a top side and an opposite bottom side, said bottom side in contact with the ocean;

a support platform, having a top surface and a bottom surface platform, said support platform having an opening providing access to the ocean surface;

a motorized winch attached to the top surface of said support platform adjacent to the opening in said platform;

a control unit having a remote operation capability to said control unit mounted to said support platform and connected to said motorized winch;

a power source mounted to said support platform and connected to said control unit; and a lifting line having one and connected to said winch and an opposite end extending through the opening in said support platform, and having a length sufficient to reach a salvage item beneath the ocean surface when said line is discharged by said winch.

14. The system of claim 13 further comprising means for pre-setting a height at which said salvage item can be stopped as it is lifted from its subsurface location.

15. A remotely operable, floating system for lifting underwater salvage items to the ocean surface, comprising:

means for providing flotation on the ocean surface, said means having a top side disposed above the ocean surface and an opposite bottom side in contact with the ocean;

a floor-like support means having one side facing away from the ocean surface and an opposite side facing the ocean surface, affixed to the top side of said flotation providing means, said floor-like support means having a centrally located opening therethrough providing a passage from the side facing away from the ocean through the side facing the ocean;

means for attaching to and lifting underwater salvage items to the ocean surface, said means affixed to said support means and comprising:

a motorized winch mounted to said floor-like support means;

a cable-like means having one end connected to said winch and an opposite end having a means for securing said underwater salvage to said cable-like means means for providing stored energy to operate said motorized winch, said stored energy providing means affixed to said support means;

means for remotely controlling the operation of said attaching and lifting means, said controlling means connected between said motorized winch and said stored energy means, said remotely controlling means disposed upon said support means;

means for protecting the bottom of said flotation providing means, said protecting means affixed to the bottom side of said flotation providing means and having a centrally located hole therethrough; and means disposed between said cable-like means and an appropriately located stop switch electrically connected between said winch and said means for providing stored energy for pre-setting a stop point at which said salvage item can be stopped as it is lifted from its subsurface location.

16. The system of claim 15 wherein said winch is mounted to the side of said floor-like support means facing away from the ocean and said cable-like means extends from said winch through said opening and through the centrally located hole in said bottom protecting means into said ocean.

* * * * *